United States Patent [19]

Ingram et al.

[11] 4,326,572

[45] Apr. 27, 1982

[54] WOOD MOLDING ROUTING APPARATUS

[75] Inventors: Harry T. Ingram, Raleigh; Larry R. Ingram, Princeton, both of N.C.

[73] Assignee: Woodtech, Inc., Princeton, N.C.

[21] Appl. No.: 160,092

[22] Filed: Jun. 16, 1980

[51] Int. Cl.[3] ..... B27C 5/02

[52] U.S. Cl. ..... 144/133 R; 83/390; 144/3 B; 144/136 R; 144/326 R; 409/134; 409/153; 409/174

[58] Field of Search ..... 409/132, 134, 137, 138, 409/151, 153, 155, 158, 164, 170, 174, 198; 408/44, 50, 52; 83/380, 390; 144/3 R, 3 A, 3 B, 3 C, 69, 71, 79, 84, 133 R, 134 R, 134 A, 136 R, 136 C, 134 D, 134 B, 134 C, 146, 147, 323, 326 R

[56] References Cited

U.S. PATENT DOCUMENTS

| | | | |
|---|---|---|---|
| 2,890,730 | 6/1959 | Gottleb | 144/84 X |
| 3,754,583 | 8/1973 | Ingram | 144/133 R |
| 4,098,310 | 7/1978 | Sanford et al. | 144/203 |
| 4,149,819 | 4/1979 | Kitagawa | 408/50 |
| 4,243,081 | 1/1981 | Pritelli | 144/3 A |

*Primary Examiner*—W. D. Bray
*Attorney, Agent, or Firm*—B. B. Olive

[57] ABSTRACT

A wood routing machine accepts a length of wood stock, e.g., a length of preformed crown molding, and thereafter in automatic sequence clamps the wood stock at lengthwise spaced locations, routs evenly spaced notches along the length of the stock and after each router operation automatically unclamps and indexes the stock a predetermined distance, again clamps the stock and repeats the router operation sequence until the entire length of stock has been notched to form a length of dental block type wood molding.

7 Claims, 10 Drawing Figures

WOOD MOLDING ROUTING APPARATUS

BACKGROUND OF THE INVENTION

1. Field of the Invention

The invention relates to routing apparatus for forming wood molding of the dental block type.

2. Description of the Prior Art

So-called dental block type wood molding comprises a length of rectangular molding having a plurality of evenly-spaced notches. This type of molding has enjoyed widespread popularity and use as decorative ceiling, portal, and fireplace molding, particularly in Colonial and Georgian architecture.

The conventional method of manufacturing dental block wood molding involves use of a dado attachment, normally on a radial arm type power saw, and physical marking of the lumber to be cut at the desired evenly-spaced intervals. The lumber is then cut at the marked intervals by manually indexing the workpiece past the saw, and cutting each notch individually. The conventional process is quite time consuming and results in dental block molding being priced comparatively higher than other moldings. In addition, manual indexing of the workpiece often leads to uneven spacing of the notches. If, for example, an operator neglects to space an interval following the last notch cut and subsequently cuts a notch where there should have been a space, much time and finished work on that particular workpiece are wasted.

With these drawbacks in mind, applicant introduced an indexing mechanism for dental block wood molding in conjunction with a radial arm type power saw adapted for dado cutting. U.S. Pat. No. 3,754,583 covers this mechanism which substantially improved the accuracy and quality of dental block wood molding and also provided a means for speeding up the manufacture of such molding.

However, even with applicants' introduction of the apparatus described in U.S. Pat. No. 3,754,583, it was desirable to be able to further cut cost and labor and to be able to rapidly and automatically index stock lumber at automated rates. It was recognized that with such a machine, an operator would not only be capable of drastically increasing productivity but would also be relieved of the chance of human mistakes and resultant waste would be virtually eliminated. The provision of such a machine thus has become the principal object of the present invention.

SUMMARY OF THE INVENTION

A machine is provided for automatically routing dental block wood molding by forming notches along the length and front face of the workpiece. The machine incorporates a base frame on which is mounted a plurality of pivotal industrial type routers. Upon placing a piece of stock lumber on the base frame, a plurality of side roller clamps engage the outer edge of the lumber and hold it against the frame back and a plurality of vertical clamps engage the top surface of the lumber and hold it against the frame base. An indexing mechanism is engaged and moved into contact with the trailing end of the lumber piece. The routers are energized and through appropriate automatic controls cut a series of notches in the lumber piece. Once the initial set of notches are made in the workpiece, the vertical clamps automatically release, the lumber workpiece is automatically indexed a predetermined distance on the base frame, the vertical clamps once again automatically engage and clamp the top surface of the workpiece and the routers automatically cut another series of notches. This automatic operational sequence is repeated until the entire workpiece has been notched and formed into a finished dental block wood molding strip. Once all notches have been made, the top and side clamps automatically release, enabling the indexing mechanism to be manually returned to its start position by the operator and the completed workpiece removed from the machine preparatory for inserting a new workpiece and repeating the sequence.

DESCRIPTION OF THE PREFERRED EMBODIMENT

Figure 1:
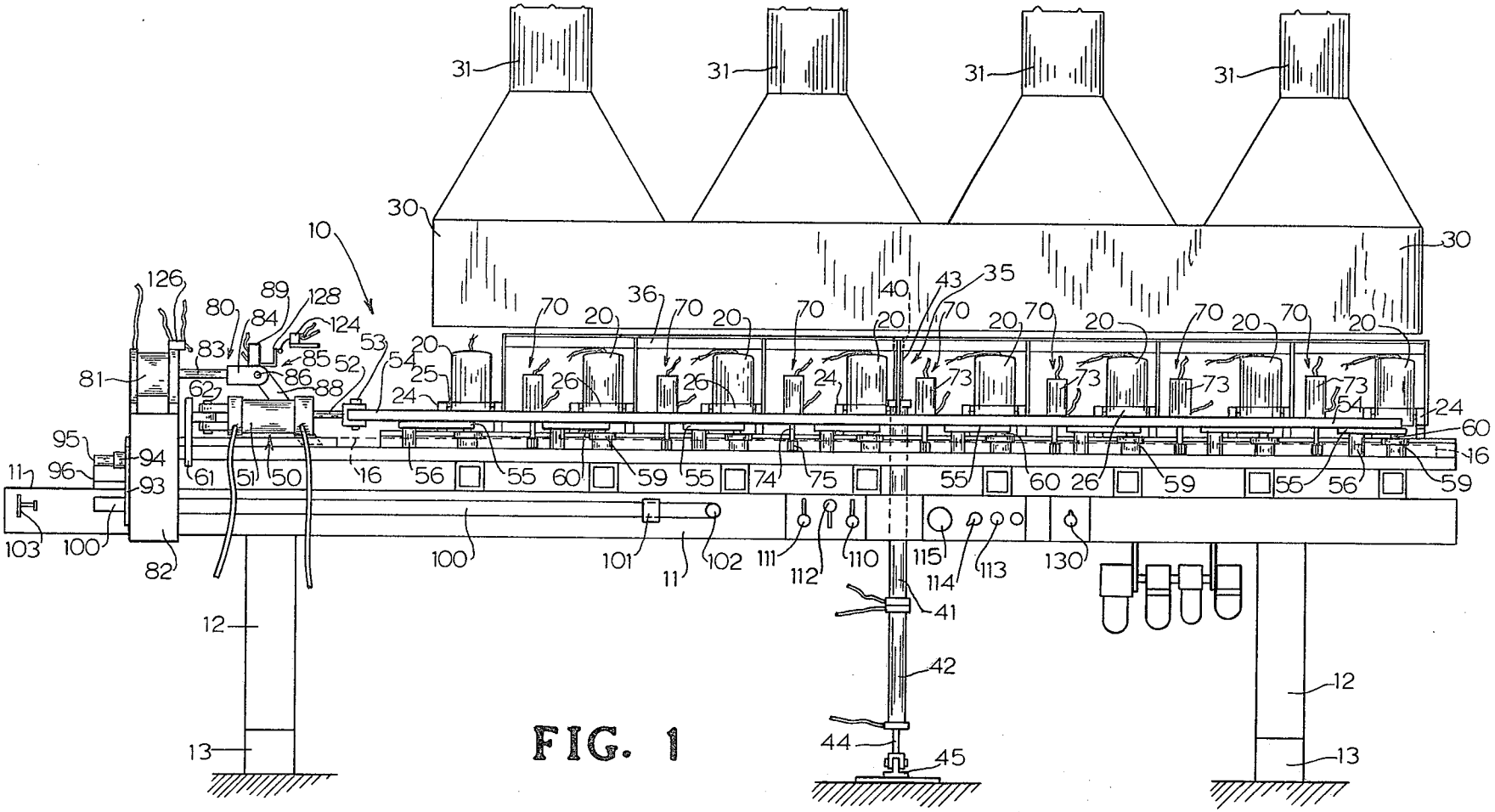
FIG. 1 is a front elevation view of the machine of the present invention for routing dental block wood molding.

Referring to FIG. 1 of the drawings, machine 10 of the invention incorporates means for automatically clamping, routing and indexing a wood workpiece, e.g., a length of preformed crown molding, to produce a length of dental block type wood molding. The wood molding routing machine 10 of the invention has a frame 11 with legs 12 and feet 13 and on frame 11 a work base or table 14 which has a channel 15 formed and fixed along the rear edge thereof. Channel 15 is designed to receive and guide a piece of stock molding material 16 while being notched by the machine 10 as later described.

A series of conventional, industrial type electrically powered routers 20, eight being illustrated, are mounted at evenly spaced intervals by means of supports 23 which are integrally secured to frame 11 and extend outwardly across work base 14. In one embodiment, routers 20 were spaced on 2' centers and were powered by 2½ horsepower electric motors. The router shafts 21 and router blades 22 are oriented so as to extend downwardly toward the molding piece 16. The series of routers 20 are adapted to be tilted back and forth in unison and, for this purpose, bearings 24 are fixedly secured to supports 23 and rotatably receive stub shafts 25. Shafts 25 are fixedly secured to and extend outwardly from routers 20 enabling routers 20 to pivot about the horizontal axis of shafts 25. A clear shield 26 is fixedly secured to the free ends of supports 23 for each router 20 so as to protect the machine operator from any wood chips or dust which might be thrown out by router blades 22. Wood dust and small wood debris is drawn from machine 10 by hood 30 and associated air vacuum ducts 31 so as to minimize the amount of dust which collects or builds up around routers 20 and on work base 14.

As previously stated, routers 20 are pivotal with shafts 25 within bearings 24. The amount of pivotal movement is in turn controlled by the router pivot mechanism 35. Pivot mechanism 35 includes a tilting frame made up of horizontal member 36 which extends lengthwise of machine 10 and further includes shaft connecting arms 37. Each router 20 has a connecting arm 37 rigidly secured to one end of a shaft 25 on the outside end of a bearing 24. As each arm 37 pivots, the corresponding shaft 25 is caused to rotate within its bearing 24. Thus, routers 20 can be pivoted back and forth by raising and lowering of horizontal member 36 and corresponding pivoting of arms 37.

Figures 2, 10:
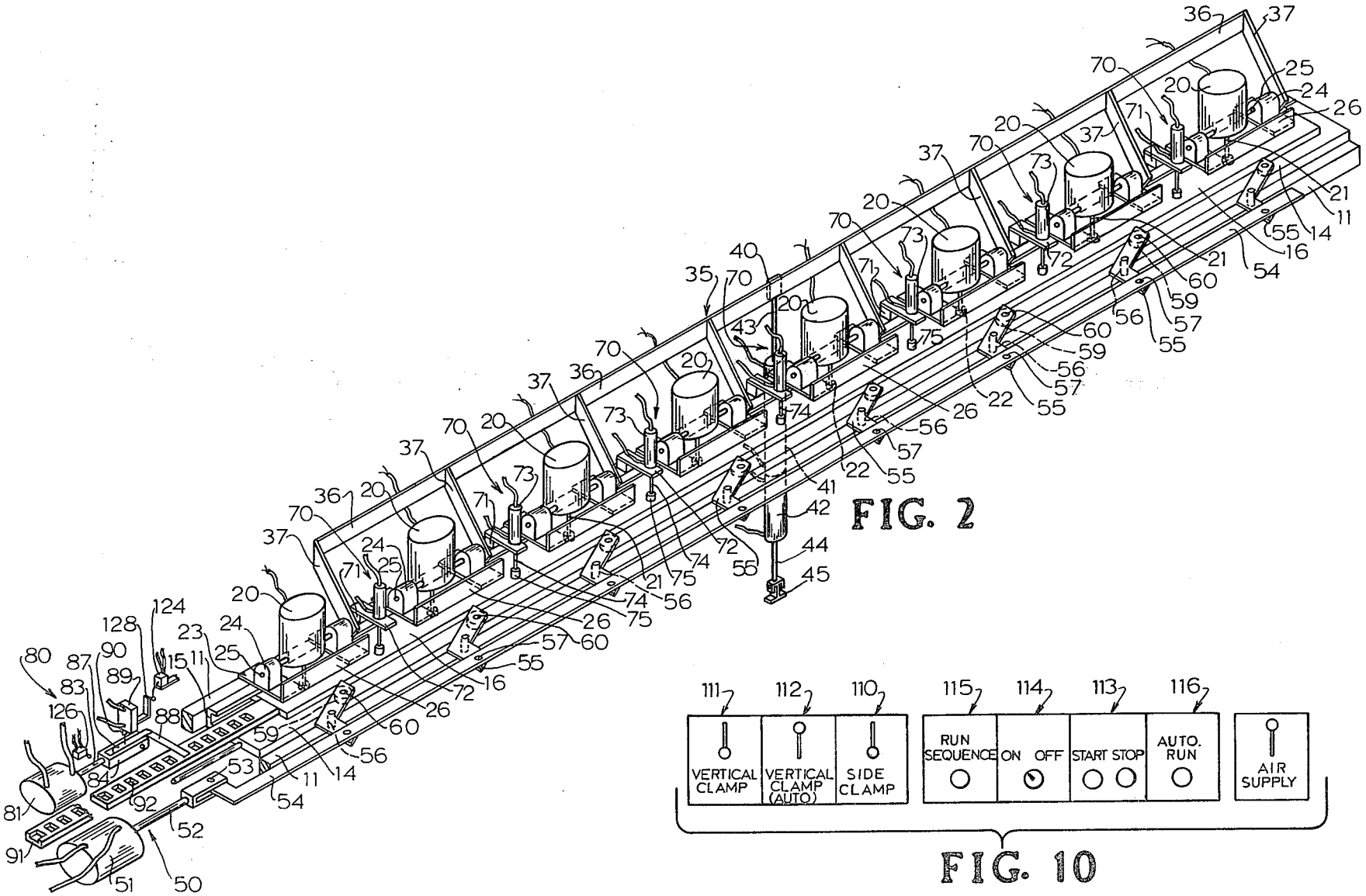
FIG. 2 is a fragmentary pictorial view of the routing, clamping and indexing mechanisms of the invention.
FIG. 10 is a diagram of the air and electric operator circuits and controls.
Figure 4:
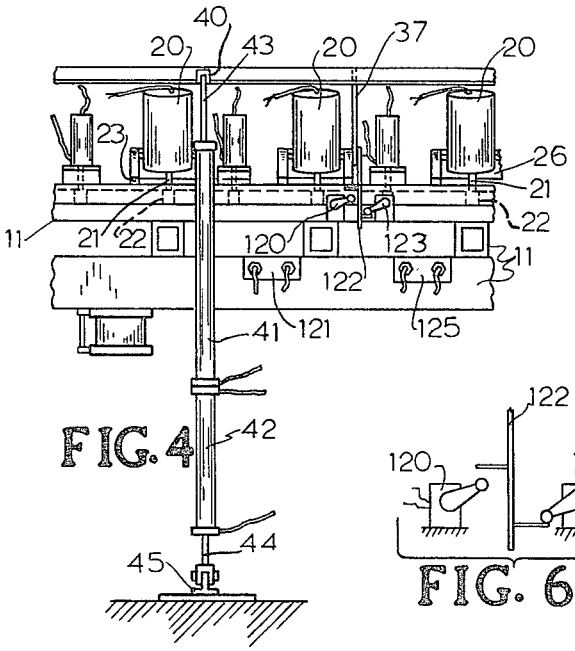
FIG. 4 is a fragmentary, rear elevation view of the machine of FIG. 1 and illustrating specifically the router tilt mechanism and controls.
Figure 5:
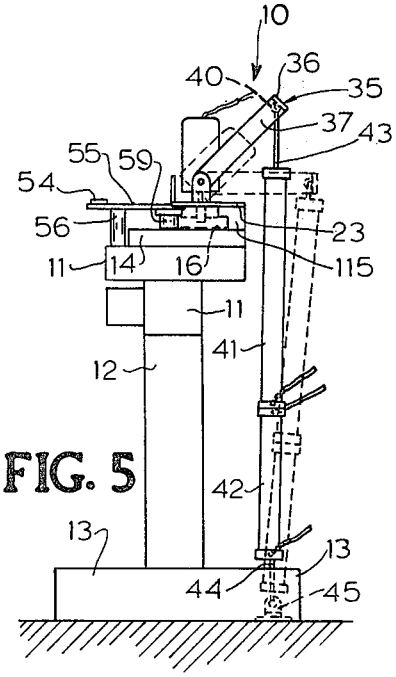
FIG. 5 is a right end elevation view of the machine of the present invention and in dashed lines illustrating a second position of a router and the tilt mechanism.
Figure 7:
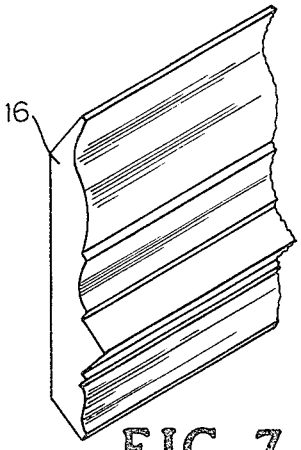
FIG. 7 is a perspective fragmentary view of a length of preformed crown molding prior to being operated on by the machine of the invention.
Figure 8:
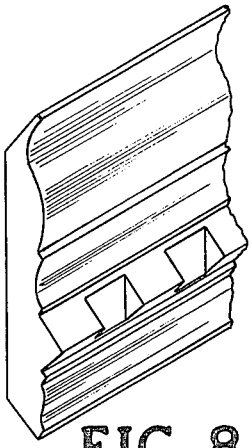
FIG. 8 is a perspective view of the FIG. 7 crown molding after being notched by the machine of the invention.
Figure 9:
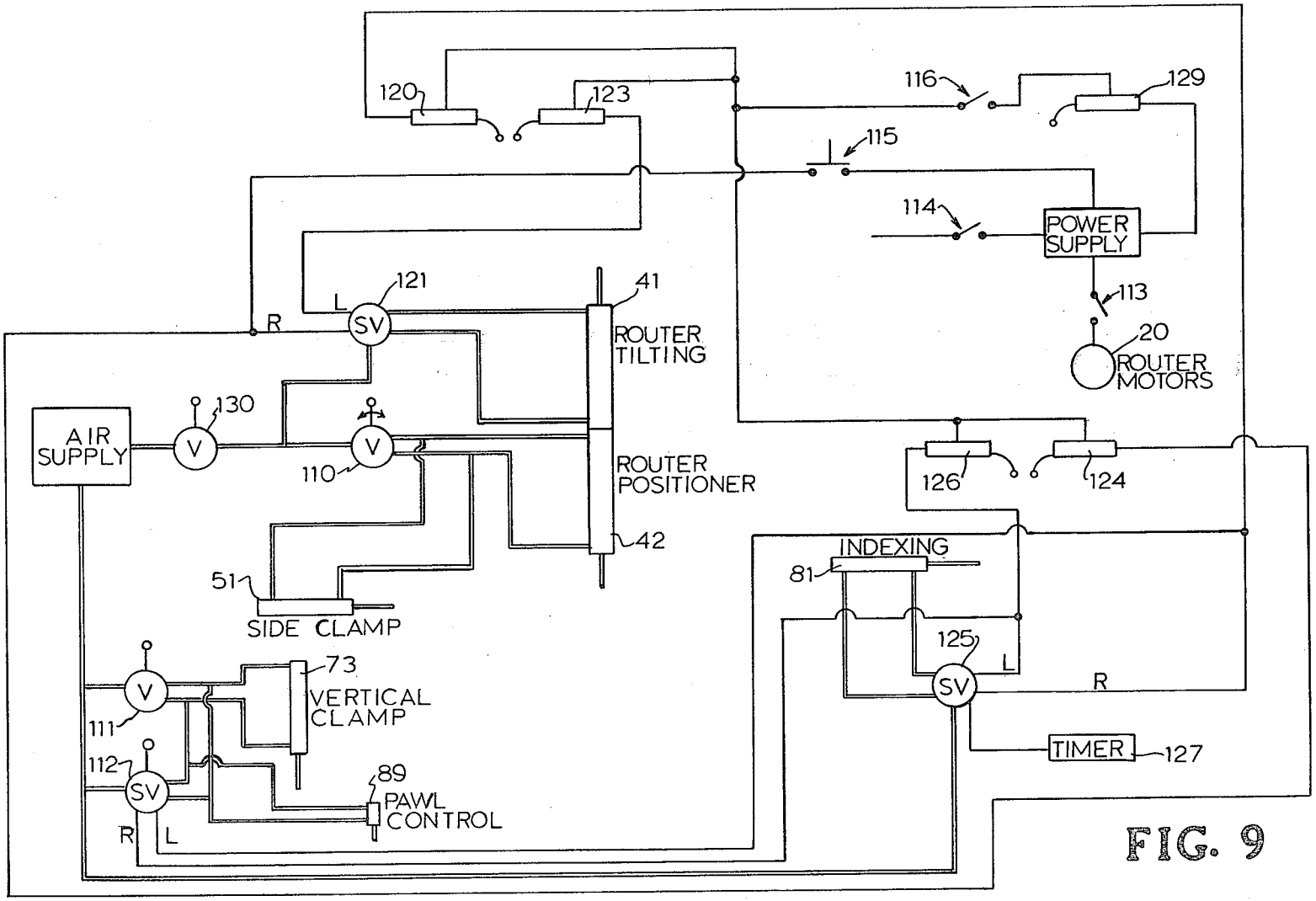
FIG. 9 is a schematic control diagram.

With continuing reference to the router pivot mechanism 35, a bracket 40, seen in FIGS. 2, 4 and 5, is fixedly secured approximately midway of horizontal member 36. A pair of axially aligned, double acting air cylinders 41, 42 are rigidly secured to each other, end-to-end, and are arranged with piston rod 43 of cylinder 41 having a pivotal connection to bracket 40 and piston rod 44 of cylinder 42 having a pivotal connection to a fixed floor bracket 45. While either air or hydraulic cylinders are suited to the invention, oil lubricated air cylinders are used by way of example. The controls for machine 10 are discussed in later description. However, it may be recognized at this point that upward movement of the piston rod 43 of cylinder 41 will cause shaft connecting arms 37 and, in turn, the router shafts 25 to move counterclockwise (as viewed in FIG. 5) which, in turn, causes routers 20 to move and follow the counterclockwise movement of arms 37. Such movement, in turn, causes the router blades 22 to cut into the stock lumber piece 16 and form respective notches or slots therein. In this regard, it may be noted that FIG. 7 illustrates as an example a typical piece of stock crown type molding in the form in which it is placed into machine 10 prior to the notching operation performed by machine 10 and FIG. 8 illustrates the workpiece after the notching operation has been performed by machine 10.

It has been found desirable that the workpiece 16 be firmly clamped both from the top and side during the notching operation performed by machine 10. Thus, machine 10 provides two separate clamping operations for this purpose to minimize vibration and movement of the workpiece during the notching operation. One clamping operation, i.e., the side clamping operation, is effectively maintained at all times while the workpiece is being operated upon. The second clamping operation, i.e., the top clamping operation, involves sequential clamping and unclamping coordinated with each routing operation. The description will first be directed to the clamping operation and clamping mechanism performed on the side of the workpiece. For reference, the side clamping mechanism is referred to as the first clamping mechanism 50 and which engages the stock lumber piece 16 during the complete routing operation.

The first side clamping mechanism 50 is operated by air cylinder 51 and its associated piston rod 52. Piston rod 52 is, in turn, pivotally secured by pin 53 to an elongated arm 54 which extends along the front of machine 10 for substantially its entire length. A series of crank arms 55 are mounted for pivoting in a horizontal plane on vertical posts 56 mounted at spaced intervals along the front portion of frame 11 with crank arms 55 being pivotally secured to elongated arm 54 by pins 57. A rolling clamping effect on the side edge of workpiece 16 is effected by means of rollers 59 which are rotatably mounted on pins 60 at the free ends of crank arms 55. Rollers 59 are, thus, designed to engage the lumber piece 16 on the outside edge thereof and force the opposite edge of the lumber piece 16 against channel 15 so that it will be firmly secured during the notching operation.

Figure 3:
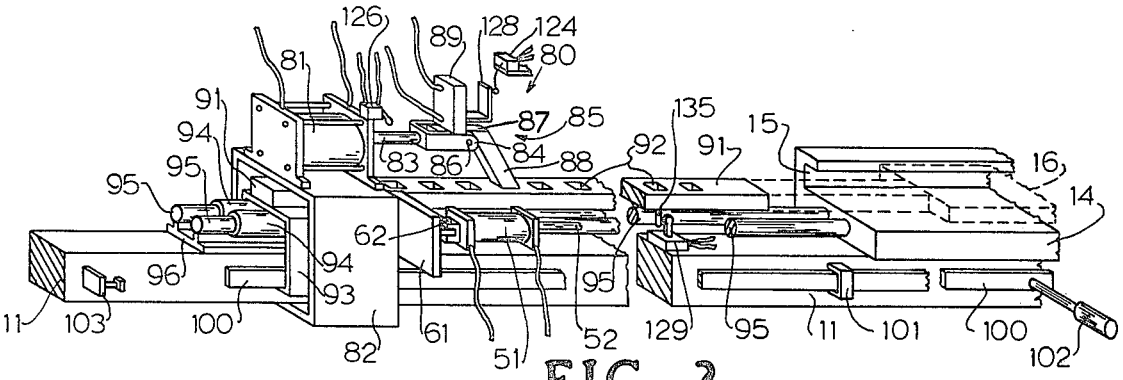
FIG. 3 is an enlarged, fragmentary, perspective view of the indexing mechanism of the invention.

Engaging and disengaging of rollers 59 from the workpiece 16 is controlled by operation of the double acting air cylinder 51 which is pivotally secured as seen in FIGS. 1 and 3 to a brace 61 on frame 11 and pivots on pin 62. As best seen in FIG. 2, it will be noted that whenever piston rod 52 is extended, crank arms 55 will pivot on posts 56 and, in turn, force rollers 59 to engage the outer side edge of the lumber piece 16. It can also be noted that when piston rod 52 is retracted rollers 59 are moved away from lumber piece 16 by the same pivoting action on posts 56. Thus, rollers 59 can be maintained in tight rolling contact against lumber piece 16 throughout the routing operation performed by routers 20. Furthermore, this arrangement allows the lumber piece 16 to be indexed and advanced step-by-step without requiring the rollers 59 to be disengaged.

In addition to providing means for maintaining the workpiece 16 firmly clamped against channel 15 throughout the routing operation, machine 10 also incorporates mechanism for clamping the top surface of the workpiece 16 against the table 14. This vertical clamping operation is referred to as the second clamping operation and is performed by what is referred to as the second clamping mechanism 70. The second clamping mechanism 70 performs a clamping and unclamping operation in timed sequence with each routing operation and indexing of the lumber piece 16. A mounting arrangement for clamping mechanism 70 is provided by means of blocks 71 secured to frame 11 and mounting plate members 72 which extend outwardly and overlie the top surface of the workpiece 16. Double acting air cylinders 73 are mounted on the outer ends of plate members 72 and incorporate piston rods 74 arranged to slide through appropriate holes, not shown, in plate members 72. Rubber grips 75 are mounted on the bottom ends of the vertically positioned piston rods 74 and when cylinders 73 are energized are adapted to contact and firmly engage the top surface of the lumber piece 16 at evenly-spaced points substantially midway between each router 20. The air cylinders 73 associated with the second clamping mechanism 70 operate simultaneously by means of appropriate controls as later described.

In addition to the first clamping mechanism 50 and second clamping mechanism 70, previously described, machine 10 also incorporates the indexing mechanism 80 which allows the workpiece 16 to be automatically indexed in timed sequence with the notching operation performed by routers 20. Indexing mechanism 80 can best be seen in FIGS. 2 and 3. The indexing operation is performed by means of a double acting air cylinder 81 secured to an auxiliary frame 82 which encircles and is secured to the main frame 11, with a welded securement being used by way of example. Piston rod 83 of cylinder 81 mounts on its forward end a U-shaped bracket 84. A pawl member 85 is pivotally mounted with bracket 84 by means of pin 86. Pawl member 85 has a generally horizontally disposed trailing operator portion 87 residing within bracket 84 and a forward downwardly angled pawl 88 which is designed to mate with notches 92 of the indexing bar 91 as seen in FIG. 3. Positioning of pawl member 85 and, thus, positioning of pawl 88 is controlled by means of air cylinder 89 secured to bracket 84. Piston rod 90 of cylinder 89, when extended, will thus act to contact the operator portion 87 of pawl member 85 and tilt pawl 88 in a disengaged position with respect to indexing bar 91. However, it will also be seen that when piston rod 90 of cylinder 89 is retracted, the pawl 88 of pawl member 85 is allowed to engage an appropriate notch 92 of indexing bar 91 so that indexing bar 91 can be advanced by operation of the previously-mentioned air cylinder 81 and utilizing related controls as discussed in later description.

The indexing bar 91 which is used to index the workpiece 16 is secured at its trailing end to a frame 93 which, in turn, is secured to a pair of sleeves 94 as best illustrated in FIG. 3. Sleeves 94 are slidably mounted on a pair of rods 95 fixedly secured at one end to bracket 96 and at the opposite end to base 14. Thus, indexing bar 91 and the associated sleeves 94 are allowed to move as an integral structure back and forth on the supporting rods 95. The free end of indexing bar 91 contacts lumber piece 16 which is to be notched or routed, such contact being indicated in dashed lines in FIG. 3. Thus, when piston rod 83 of cylinder 81 is advanced with pawl 88 of pawl member 85 being in engagement with one of the notches 92 of indexing bar 91, the workpiece 16 will be indexed a certain incremental distance corresponding to the distance bar 91 advances.

Once the workpiece 16 has been properly clamped into position and the routing operation is ready to commence, the forward, sequential, indexing movement of indexing bar 91 is placed under automatic control as later described. Once the indexing bar has been fully indexed to its maximum extent, provision is made for retracting the indexing bar 91 by a manual operation. For this purpose, a return bar 100 is integrally secured to frame 93 as seen in FIG. 3 so that rearward movement of return bar 100 effects rearward movement of indexing bar 91 to its starting position. The return bar 100 is located for operator convenience and extends along the front side surface of frame 11 and through a guide bracket 101 on the front side surface of frame 11. A handle 102 extends outward from the free end of return bar 100 and is used to manually move the indexing bar 91 rearward with such rearward movement being limited by a stop member 103 secured to frame 11.

Having now described the construction and general operation of the routing, clamping and indexing mechanisms, the description will next refer to a typical operation of machine 10 and with more specific reference to various operator controls and limit switches utilized for the automatic operations associated with machine 10.

Initially, the piece of stock molding 16, as illustrated in FIG. 7, is placed in machine 10 from the front or operator side and is positioned under the routers 20 and pushed to the left as viewed in FIG. 2 such that the trailing end of the workpiece, i.e., molding 16, will engage the forward end of the indexing bar 91. Prior to placing molding 16 into machine 10 in the described manner, the indexing bar 91 will have been previously moved to the extreme starting position in which bar 100 is in contact with stop member 103. At this time, pawl 88 of pawl member 85 will also be seated in the first notch at the forward end of the indexing bar 91. The operator then clamps molding 16 in place utilizing the first clamping mechanism 50 by means of a four-way hand operated valve 110 which acts to energize cylinder 51 such that rollers 59 are tightly pressed against the side of molding 16. Additionally, valve 110 also controls cylinder 42 seen in FIG. 2 such that routers 20 are set in a starting position, i.e., in a vertical position. Once rollers 59 have been engaged in this manner by manual operation of value 110, they will remain engaged throughout the routing operation until the notching of the molding workpiece 16 has been completed and is ready to be removed from the machine 10 as later described. It may also be noted that extension of piston rod 44 of cylinder 42 for the purpose of putting routers 20 in the vertical starting position only takes place at the beginning of the routing operation and piston rod 44 thus remains extended throughout the routing operation and the tilting of routers 20 back and forth to accomplish the desired notching is accomplished by extension and retraction of piston rod 43 associated with cylinder 41 in a manner later described.

After routers 20 have been placed in the vertical starting position and rollers 59 placed in their clamping position as previously described, the operator then manually actuates another four-way control valve 111, which effectively manually bypasses the automatic controls, and causes the series of vertical clamping cylinders 73 associated with the second clamping mechanism 70 to be energized in a manner adapted to cause the grips 75 to press the molding workpiece 16 against the base table 14. Next, in order to place the operation of the second clamping mechanism 70 incorporating the vertical clamping cylinders 73 under automatic control, the operator actuates valve 112 which operates under limit switch control and causes the piston rods 74 of cylinders 73 and the associated attached grips 75 to engage and disengage in automatic timed sequence with the back and forth movement of routers 20. The operator next pushes the electric start button 113 which is connected to start the eight electrically-powered routers 20. At this stage, it should be appreciated that the molding workpiece 16 is tightly clamped from the side by the action of rollers 59 and on the top surface by the action of the rubber grips 75, the routers 20 are operating and in a vertical starting position, and the indexing bar 91 is stationary. Since the automatic operations associated with the machine 10 utilize the later-described limit switches 120, 123–124, 126 and 129, the operator presses the electrical start/stop switch 114 to apply power to the limit switches and place them in the automatic control circuit. Once the limit switches have been energized, the operator now pushes a momentary contact button 115 which starts the operating sequence.

Momentary contact button 115 is connected to limit switch 124 which, when not in contact with arm 128, as later described, establishes a circuit through limit switch 124 effective to actuate the solenoid controlled valve 121 on what will be referred to as the right port side as such terminology is used in the solenoid air valve art. Valve 121 controls air communication to cylinder 41 such that when valve 121 is actuated on its right port side, piston rod 43 of air cylinder 41 is caused to be extended and through the linkage provided by bar 36, arms 37, and shafts 25, causes the routers 20 to be tilted and their associated router blades 22 to pass through molding 16 and form notches as illustrated in FIG. 8.

Figure 6:
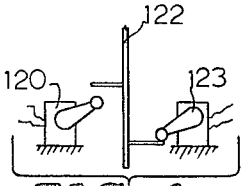
FIG. 6 is an enlarged fragmentary view of a limit switch arrangement employed.

After router blades 22 have passed completely through molding 16, the arm 122, seen in FIGS. 4 and 6, connected to one of the routers 20 and its shaft connecting arm 37 actuates a limit switch 123. Limit switch 123 is in electrical circuit with the solenoid controlled air valve 121 and when actuated by striking arm 122 causes valve 121 to be activated on the left port side. Activation of valve 121 on the left port side causes the cylinder rod 43 of cylinder 41 to retract and thereby cause routers 20 to tilt in a reverse direction through the previously formed notches in molding 16. On this reverse tilting of routers 20, the previously mentioned arm 122 strikes another limit switch 120 which is electrically connected to and activates the right port side of air solenoid valve 125 which, in turn, controls the air supply to the indexing cylinder 81. The piston rod 83 of cylinder 81 is caused to retract which allows pawl 88 of pawl member 85 to drop down into the next trailing notch 92 in indexing bar 91 which remains flush against the end of molding 16.

As previously mentioned, the rollers 59 remain in rolling, clamping contact with the side edge of the molding 16 throughout the router notching operation. However, it becomes necessary with the described embodiment to retract the vertical clamping grips 75 to allow the molding workpiece 16 to be indexed, following which the mentioned grips 75 are again placed in tight engagement with the top surface of the molding 16. In connection with this phase of the operation of machine 10, it will be noted that the pawl control cylinder 89 depends for its positioning on the position of piston rod 83 of cylinder 81. In this regard, it may be noted that when cylinder 81 retracts piston rod 83, cylinder 89 is arranged to strike limit switch 126 which is electrically connected to and operates to activate the left port side of solenoid control valve 125. An electrical timer 127 is electrically associated with valve 125 and is employed so that the cycle will stop for a brief interval of time sufficient to give the second clamping mechanism 70, i.e., cylinders 73, time to be energized and allow the vertical clamping grips 75 to move upwardly out of disengagement with molding 16. After passage of the time controlled by timer 127, activation of the left port side of valve 125 will be effective to cause the piston rod 83 of indexing cylinder 81 to move forward and thereby move pawl 88 against the respective engaged notch 92 of indexing bar 91 so as to push molding 16 into the next routing position. In this forward travel of cylinder 81, arm 128 (FIG. 1) strikes the previously-mentioned limit switch 124 which is electrically connected to and is effective to activate the right port side of valve 121 which, in turn, causes the piston rod 43 of cylinder 41 to be extended and to thereby repeat the cycle.

The mentioned sequential automatic operation is repeated until notches have been appropriately formed throughout the length of the workpiece 16 and that this stage of operation, arm 135 (FIG. 3) is caused to strike another limit switch 129 which effectively removes power from the limit switches by turning electrical switch 114 off. The operator then releases the air from the air-operated components of machine 10 by means of a manually-operated four-way valve 130. The operator then restores the indexing bar 91 to its starting position utilizing handle 102 and bar 100 until bar 100 contacts the previously-mentioned stop member 103. Next, the operator removes the molding 16 and inserts another piece whereupon the overall routing cycle is ready to be started again. In an actual embodiment of machine 10, a sixteen-foot piece of molding 16 was formed with 384 notches in approximately two minutes' time. Thus, the objects of the invention were fully realized.

The sequence of operations performed by machine 10 may be briefly summarized as follows:

1. The stock piece is loaded in the machine in a retracted starting position.
2. The side clamps, i.e., rollers 59, are engaged by a manual valve operation.
3. The top clamps, i.e., grips 75, are engaged by a manual valve operation.
4. Routers 20 are positioned in the vertical starting position by a manual valve operation.
5. The machine is placed under automatic control.
6. The routers are automatically tilted through the stock piece in one direction.
7. The routers are automatically tilted back in the opposite direction to their vertical starting position.
8. The top clamps, i.e., grips 75, are automatically released.
9. The stock piece is automatically advanced to the next notching position and then vertically clamped.
10. The routers are again automatically tilted through the stock piece in one direction.
11. The routers are again automatically tilted back to the starting position.
12. The top clamps, i.e., grips 75, are again automatically released.
13. The stock piece is automatically advanced to the next notching position.
14. The foregoing sequence is repeated automatically until the full length of the workpiece has been notched.
15. The machine is automatically taken off automatic control upon completion of notching of the workpiece.
16. The side and top clamps are released by manual valve control. The indexing pawl is also lifted by manual switch.
17. The indexing bar, i.e., bar 91, is manually returned to the retracted starting position.
18. A new stock piece is loaded in the retracted position and the sequence is repeated on the new workpiece.

To further explain the foregoing operational steps executed by machine 10, the following represents a summary of the principal devices, their purpose and the related control function:

| Device | Purpose | Control |
|---|---|---|
| Air cylinder 41 | Tilts router 20 back and forth | Automatically controlled by valve 121 and limit switches 124 and 123 |
| Air cylinder 42 | Tilts routers to starting vertical position | Manually controlled by valve 110 |
| Air cylinder 51 | Sets side clamp rollers 59 | Manually controlled by valve 110 |
| Air cylinder 73 | Actuate top clamp grips 75 | Initially set manually by manual valve 111, then placed under automatic control by valve 112. |
| Air cylinder 81 | Push pawl 88 and thereby advance index bar 91 | Under automatic control by valve 125 and limit |

-continued

| Device | Purpose | Control |
|---|---|---|
| | | switches 124, 126 and timer 127 |
| Air cylinder 89 | Raises and lowers pawl 88 | Under manual control of valve 110. |
| Return bar 100 and associated handle 102 | For return of index bar 91 | Manually operated |
| Start button 113 | Connects electric power to routers 20 | Manual |
| Start/stop switch 114 | Electrically energizes all limit switches | Manual |
| Contact button 115 | Provides electric power to start sequence by operating solenoid valve 121 through limit switch 124 to cause cylinder 41 to operate and thereby cause routers 20 to tilt through stock | Manual momentary contact |
| Limit switch 124 | Activates right port side of valve 121 to cause cylinder 41 to extend | Arm 128 |
| Limit switch 123 | Activates valve 121, left port side, to cause cylinder 41 to retract | Arm 122 (FIG. 4) |
| Limit switch 120 | Activates valve 125, right port side, to cause cylinder 81 to retract | Arm 122 (FIG. 4) |
| Limit switch 126 | Activates left port side of valve 125 | Cylinder 89 (FIG. 2) striking limit switch |
| Limit switch 129 | Automatically shuts off machine when indexing bar 91 reaches its limit | Arm 135 (FIG. 3) on indexing bar 91 striking limit switch |

In summary then, it can be seen that the invention has provided a very rapid and efficient method for notching a wood workpiece and particularly for operating on a preformed piece of molding, such as crown molding, to convert the same to a dental block type molding.

What is claimed is:

1. Apparatus for notching a preformed wood molding piece at uniformly-spaced intervals to provide a dental molding effect, comprising:

(a) a worktable providing horizontal work support and vertical backstop surfaces for the length thereof;

(b) a plurality of powered wood routers spaced lengthwise of the table at uniform intervals and mounted for pivoting back and forth across and above the table such that the blades thereof may engage and notch any wood material in the path thereof during said pivoting;

(c) first controllable operator means for engaging and clamping an elongated wood workpiece against said horizontal and vertical surfaces at points not interfering with the path of pivoting of said router blades;

(d) second controllable operator means for pivoting said routers on the mountings thereof;

(e) third controllable operator means operative for indexing said workpiece by some predetermined distance; and (f) control means for operating said first, second and third operator means in timed sequence whereby said workpiece may be engaged and clamped at a first position on said worktable, notched by each of said routers at such position, then unclamped sufficiently to permit advancement to a second position, followed by again being clamped to permit routing thereof, repeating said notching at said second position and repeating this sequence until the workpiece has been notched throughout its length to produce a dental-type molding therefrom.

2. An apparatus as claimed in claim 1 wherein said first operator means includes operator means controlled by said control means for continuously engaging the side of said workpiece throughout the notching operation performed thereon.

3. An apparatus as claimed in claim 2 wherein said third operator means includes a notched indexing bar arranged to engage the trailing end of said workpiece, a pivotal pawl adapted to engage a selected notch in said indexing bar and means controlled by said control means for sequentially retracting and advancing said pawl to effect indexing of said bar.

4. An apparatus as claimed in claim 3 wherein said one operator means for engaging the side of said workpiece includes a series of rollers adapted to be brought into rolling engagement with the side of said workpiece to effect the clamping thereof.

5. An apparatus as claimed in claim 4 wherein said second operator means includes one operator means adapted for tilting said routers to a substantially vertical starting position at the start of the notching operation on said workpiece and which is adapted to thereafter remain in operation until such notching operation has been completed on said workpiece.

6. The method of notching a preformed wood molding piece at uniformly-spaced intervals to provide a dental molding effect comprising the steps:

(a) clamping the workpiece to respective horizontal work support and vertical backstop surfaces for substantially the entire length thereof and below a plurality of powered wood routers spaced lengthwise of said work support surfaces at uniform intervals and mounted for pivoting back and forth across and above the workpiece such that the blades thereof may engage and notch any wood material in the path thereof during said pivoting; and (b) in timed sequence pivoting said routers through said wood piece to form notches at each location of said routers and in timed sequence with each said pivoting of said routers indexing said workpiece and repeating said tilting of said routers and continuing such sequence until the workpiece has been notched throughout its length to produce a dental-type molding therefrom.

7. An apparatus as claimed in claim 1 wherein said first operator means includes another operator means controlled by said control means for intermittently engaging the top surface of said workpiece at points spaced lengthwise of said table and offset from the location of said routers with such intermittent engagement being timed to occur during pivoting of said routers.

* * * * *